US006530490B1

(12) United States Patent
Kosann et al.

(10) Patent No.: US 6,530,490 B1
(45) Date of Patent: Mar. 11, 2003

(54) RECONFIGURABLE RETAIL MERCHANDISING SYSTEM

(75) Inventors: Rod G. Kosann, New Canaan, CT (US); Kevin Mullaney, Larchmont, NY (US)

(73) Assignee: KMA Licensing, Inc., Greenwich, CT (US)

( * ) Notice: Subject to any disclaimer, the term of this patent is extended or adjusted under 35 U.S.C. 154(b) by 0 days.

(21) Appl. No.: 09/809,609

(22) Filed: Mar. 15, 2001

(51) Int. Cl.[7] ..... A47B 47/00
(52) U.S. Cl. ..... 211/189
(58) Field of Search ..... 211/189, 192, 211/85.3, 204, 198

(56) References Cited

U.S. PATENT DOCUMENTS

| | | | | | |
|---|---|---|---|---|---|
| 3,101,681 | A | * | 8/1963 | Streater | |
| 4,155,461 | A | | 5/1979 | Young, Jr. | 211/86 |
| 4,232,845 | A | | 11/1980 | Turner | 248/49 |
| 4,329,003 | A | | 5/1982 | Manchester | 312/245 |
| 4,351,621 | A | | 9/1982 | Liou | 403/217 |
| 4,406,437 | A | | 9/1983 | Wright | 248/529 |
| 4,434,900 | A | * | 3/1984 | Cook | |
| 4,508,231 | A | | 4/1985 | Honickman | 211/199 |
| 4,548,378 | A | | 10/1985 | Worralo | 248/558 |
| 4,660,339 | A | | 4/1987 | Pax | 52/238.1 |
| 4,914,873 | A | * | 4/1990 | Newhouse | |
| 4,993,562 | A | | 2/1991 | Alperson | 211/87 |
| 5,110,080 | A | | 5/1992 | Rieman | 248/225 |
| 5,167,391 | A | | 12/1992 | Simpson | 248/220 |
| 5,255,803 | A | | 10/1993 | Pavone et al. | 211/189 |
| 5,427,255 | A | * | 6/1995 | Nook | |
| 5,465,852 | A | * | 11/1995 | Koks et al. | |
| 5,483,772 | A | | 1/1996 | Haddock | 52/25 |
| 5,511,332 | A | | 4/1996 | Sturkie et al. | 40/642 |
| 5,671,852 | A | | 9/1997 | Maharg | 211/189 |
| 5,899,035 | A | | 5/1999 | Waalkes et al. | 52/239 |
| 5,906,064 | A | | 5/1999 | Field | 40/606 |
| 5,921,044 | A | | 7/1999 | Holztrager | 52/483.1 |
| 5,961,082 | A | | 10/1999 | Walter | 248/220.21 |
| 6,082,837 | A | | 7/2000 | Battochio et al. | 312/140 |
| 6,343,701 | B2 | * | 2/2002 | Riga et al. | |

* cited by examiner

*Primary Examiner*—Alvin Chin-Shue
*Assistant Examiner*—Sarah Purol
(74) *Attorney, Agent, or Firm*—David P. Gordon; David S. Jacobson; Thomas A. Gallagher

(57) ABSTRACT

A retail merchandising display system includes reconfigurable components which may be assembled to form perimeter wall fixtures, standing fixtures, tiered tables fixtures, etc. A set of basic components is provided which can be assembled into the fixtures, and disassembled to create other fixtures. Each of the fixtures is preferably provided with cladding which can be used to convey a brand identity.

43 Claims, 15 Drawing Sheets

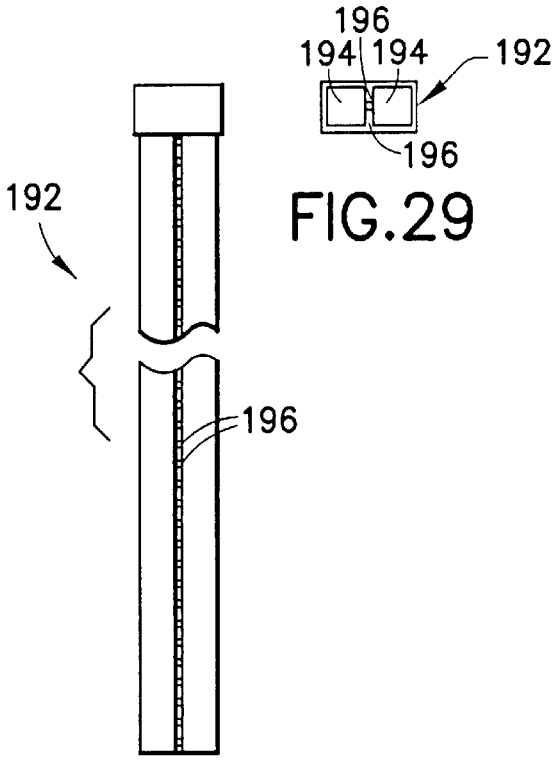
FIG.29
FIG.28
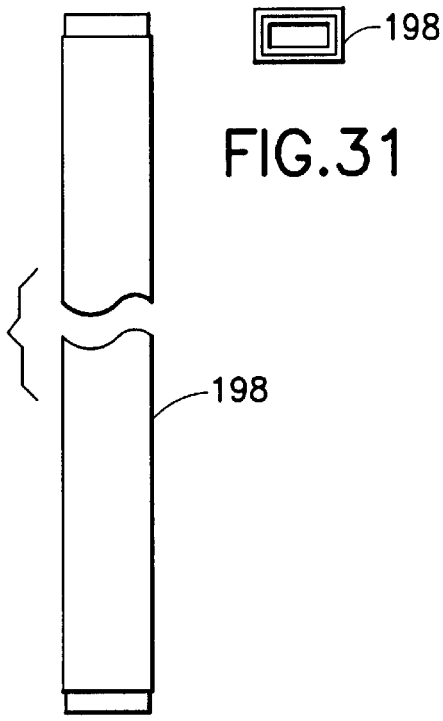
FIG.31
FIG.30
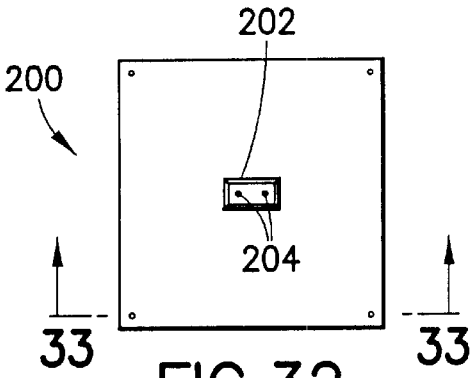
FIG.32
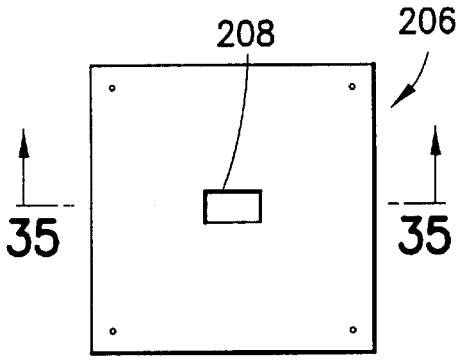
FIG.34
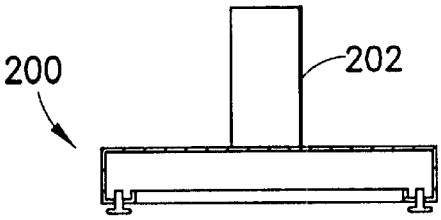
FIG.33
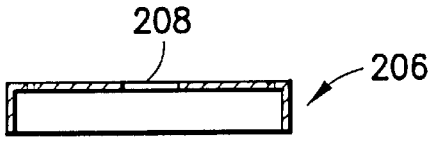
FIG.35

RECONFIGURABLE RETAIL MERCHANDISING SYSTEM

BACKGROUND OF THE INVENTION

1. Field of the Invention

This invention relates broadly to supports and racks. More particularly, this invention relates to supports and racks for the retail display of merchandise.

2. State of the Art

A relatively recent development in retail merchandising, particularly for department stores, is the concept of a "store within a store". In the "store within a store", common-branded merchandise is displayed together in a section of the store which is dedicated to that brand. The section generally includes signs for the brand, as well as perimeter wall fixtures rigidly attached to a wall and defining the space dedicated to the brand, and movable unitary floor standing fixtures and tables which are specifically designed for a brand identity. The fixtures, tables, and decor of the section generally include the mark of the brand displayed thereon and/or are coordinated in colors and even materials to correspond to the 'identity' of the brand. As such, it appears as if the dedicated section of the department store is a separate boutique within the department store for the brand of merchandise. Initially, the "store within a store" concept considerably increased sales of the brand of merchandise, and additional brands requested and were given the "store within a store" treatment. However, the cost to setting up each "store within a store" is significant. In addition, the dedicated section is custom built for a particular amount of square footage of retail display. Once the "store" is set up, it is not easy, and it is quite expensive, to make changes in the floor plan of the department store. In addition, dedicated unitary fixtures which are no longer required are generally moved to storage or discarded, as such fixtures cannot be used in association with other brands as they have an incompatible appearance. In view of the foregoing, department stores are losing the ability to make at will adjustments to the floor area dedicated to a particular brand, as any such change, even a minor change, to the size of the "store within a store" requires significant cost. Yet, it may be desirable to change the floor space dedicated to one or more brands and the number and type of floor standing fixtures and tables to alter the degree to which a department store promotes one brand over another, e.g., for purposes of holidays, sales promotions, other promotions, and agreements with a brand.

As a result of the difficulties with the lack of flexibility and ease of changeover to "store within a store" environments, many department stores are eliminating such dedicated sections of brand display. Nevertheless, provided there exists flexibility in a retail display, the "store within a store" concept of retail merchandising can be an effective means by which to increase sales of a promoted brand.

SUMMARY OF THE INVENTION

It is therefore an object of the invention to provide a retail merchandising display system which is able to rapidly be installed, removed, and reconfigurable in size and aesthetics.

It is another object of the invention to provide a retail merchandising display system which can be removably customized with a brand identity.

It is a further object of the invention to provide a retail merchandising display system which includes wall fixtures and free-standing fixtures.

It is an additional object of the invention to provide a retail merchandising display system in which the wall fixtures may easily be moved to alter the space dedicated to a brand.

It is also an object of the invention to provide a retail merchandising display system which is modular, yet appears to be custom designed for an installation.

It is yet another object of the invention to provide a retail merchandising display system which has relatively few basic components from which numerous fixtures can be assembled.

It is yet a further object of the invention to provide a retail merchandising display system in which the free-standing fixtures utilize interchangeable components.

In accord with these objects, which will be discussed in detail below, a modular retail merchandising display system is provided which includes reconfigurable basic components which may be assembled to form perimeter wall fixtures, floor standing fixtures, tables, etc. The fixtures and tables can easily be temporarily customized to a brand identity, and later disassembled and reassembled as different fixtures. According to a preferred aspect of the invention, the perimeter wall fixture assembly includes wall cleats which are securely fixed to the perimeter of a store wall, and wall standards which may be removably attached to the wall cleats at any location along their length. Panels, dividers, and bases may then be coupled to the wall standards to define a retail display section. At any time, any one or more of the panels, dividers, and bases can be detached from the standards, and the standards may be moved along the wall cleats to a new location, thereby permitting modification of the size of the retail display section. Furthermore, the fixtures and tables are assembled from several interchangeable components which can be customized and clad for brand identity.

Additional objects and advantages of the invention will become apparent to those skilled in the art upon reference to the detailed description taken in conjunction with the provided figures.

BRIEF DESCRIPTION OF THE DRAWINGS

FIG. 28 is a broken side elevation of a twin upright post according to the retail merchandising display system of the invention;

FIG. 29 is a top view of the twin upright post of FIG. 28;

FIG. 30 is a broken side elevation of a twin upright post sleeve according to the retail merchandising display system of the invention;

FIG. 31 is a top view of the twin upright post sleeve of FIG. 30;

FIG. 32 is a top view of a twin base according to the retail merchandising display system of the invention;

FIG. 33 is a section view across line 33—33 in FIG. 32;

FIG. 34 is a top view of a twin base sleeve according to the retail merchandising display system of the invention;

FIG. 35 is a section view across line 35—35 in FIG. 34;

DETAILED DESCRIPTION OF THE PREFERRED EMBODIMENTS

Figure 1:
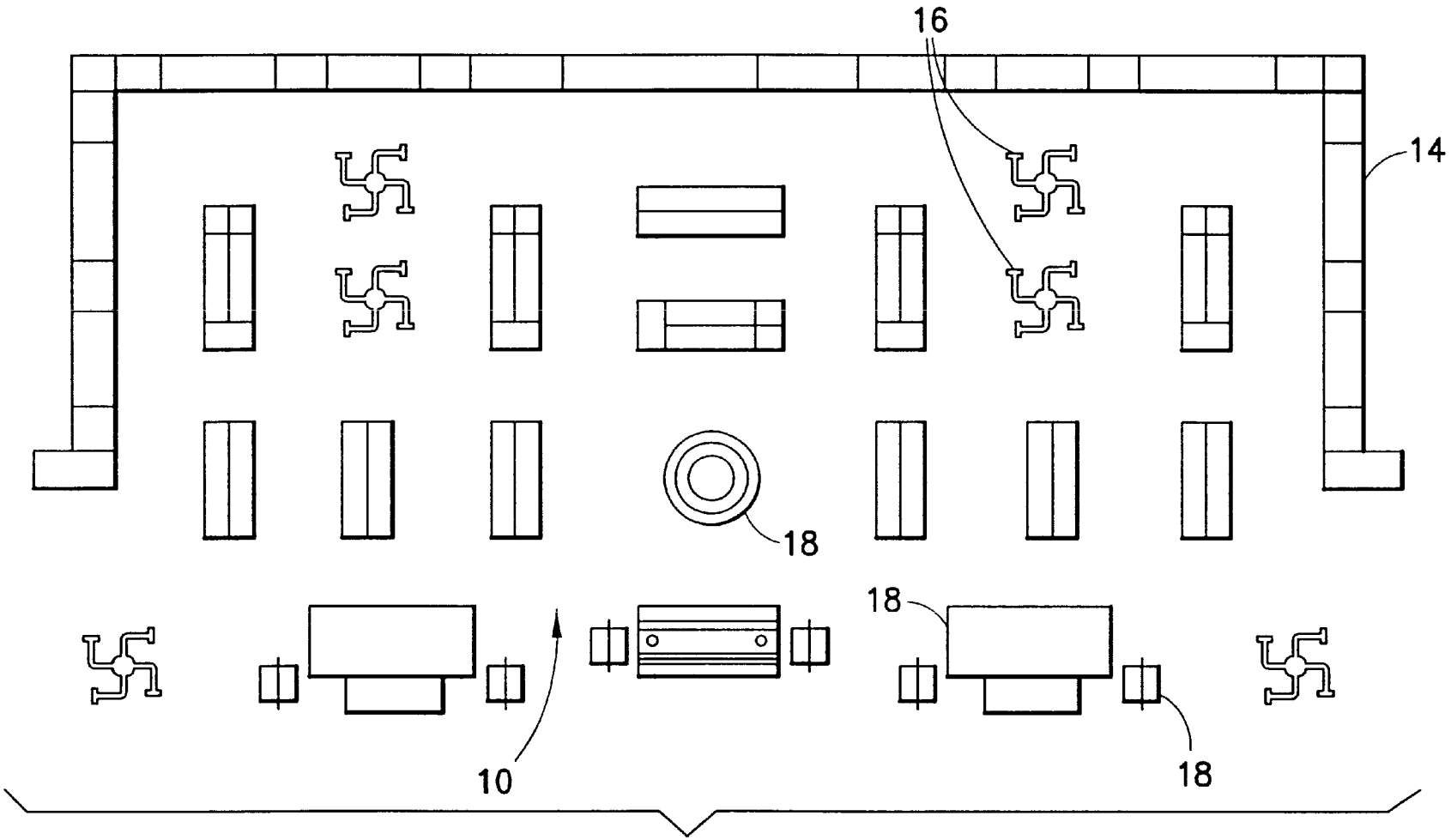
FIG. 1 is a schematic overview of a retail merchandising display layout using the retail merchandising display system of the invention.
Figure 2:
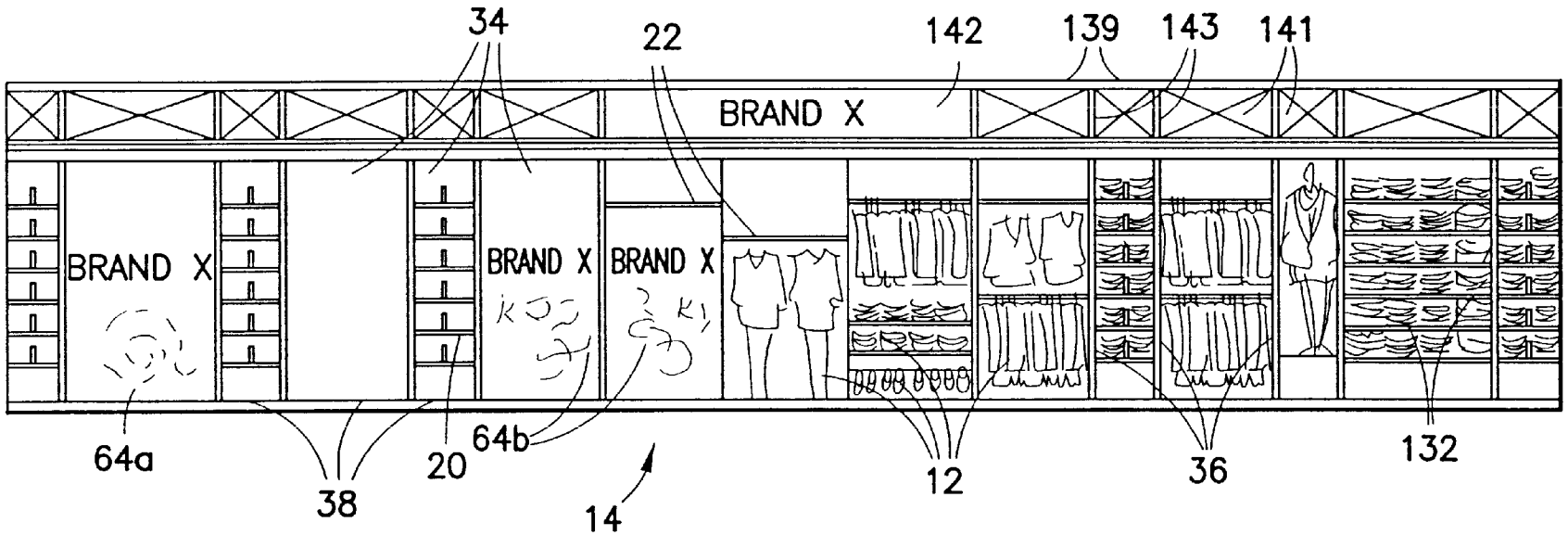
FIG. 2 is a side elevation view of a perimeter wall of the retail merchandising display system of the invention.

Turning now to FIG. 1, a schematic overview of a retail merchandising display layout is shown. The layout is comprised of various structures which together define a retail merchandising display system 10 according to the invention and which is particularly adapted for the display of apparel 12, as shown in FIG. 2. The structures include perimeter wall fixtures 14, floor standing fixtures 16 from which merchandise can be suspended, and tables 18 on which merchandise can be placed. In accord with the invention, each of the structures is comprised of basic elements which can be assembled, disassembled, and reassembled in numerous configurations.

Figure 3:
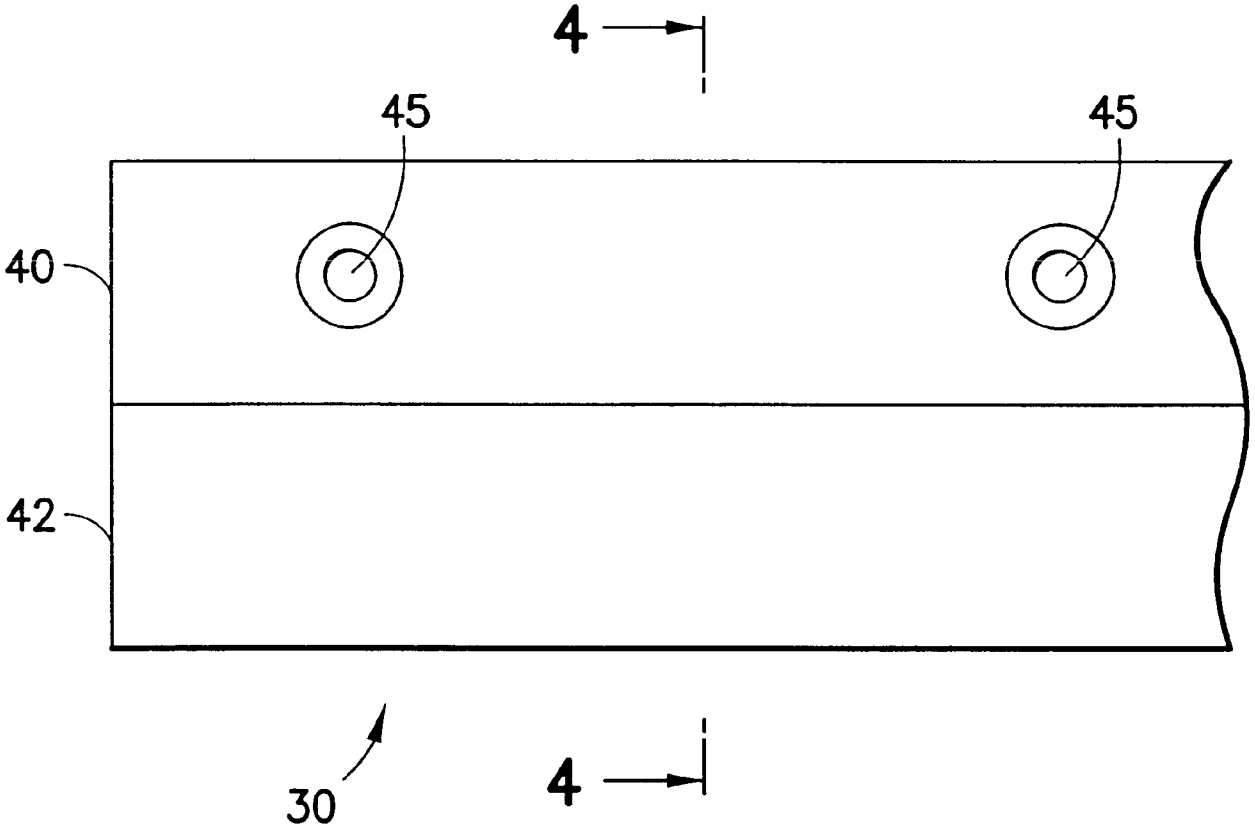
FIG. 3 is a broken front view of a wall cleat according to the retail merchandising display system of the invention.
Figure 4:
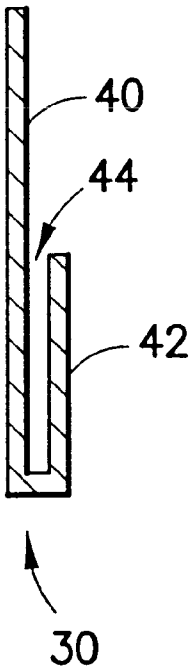
FIG. 4 is a section view across line 4—4 in FIG. 3.
Figure 13:
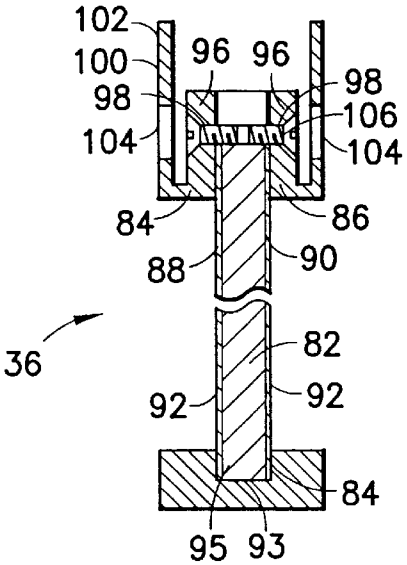
FIG. 13 is a section view across line 13—13 in FIG. 11.
Figure 14:
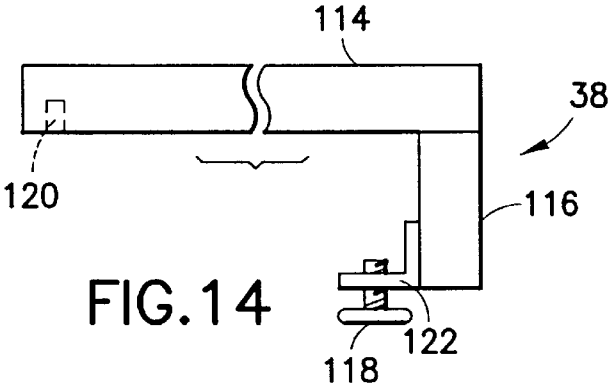
FIG. 14 is a broken partial section view of a base according to the retail merchandising display system of the invention.

More particularly, perimeter wall fixtures 14 generally include wall cleats 30 (FIGS. 3 and 4), wall standards 32 (FIGS. 5 through 7), back panels 34 (FIGS. 8–8*a*), dividers 36 (FIGS. 11–13), and bases 38 (FIG. 14). Referring to FIGS. 3 and 4, the wall cleat 30 is preferably a metal J-shaped member including a relatively larger back portion 40 and a relatively smaller front lip 42, together defining a channel 44. A plurality of holes 45 are provided in a top portion of the back portion 40 of the member. Wall fasteners, e.g., screws, (not shown) are provided in the holes 44 to securely attach the wall cleat 30 to substantially the entire length of an interior perimeter wall in the retail establishment. In order to extend this length, the wall cleat may be comprised of a plurality of linearly arranged sections. Alternatively, a unitary wall cleat having a suitable length may be used. According to a preferred embodiment of the invention, two wall cleats are permanently attached to the wall of a retail establishment in a parallel horizontal arrangement preferably six feet apart (with the lower wall cleat preferably being one foot up from the floor).

Figure 6:
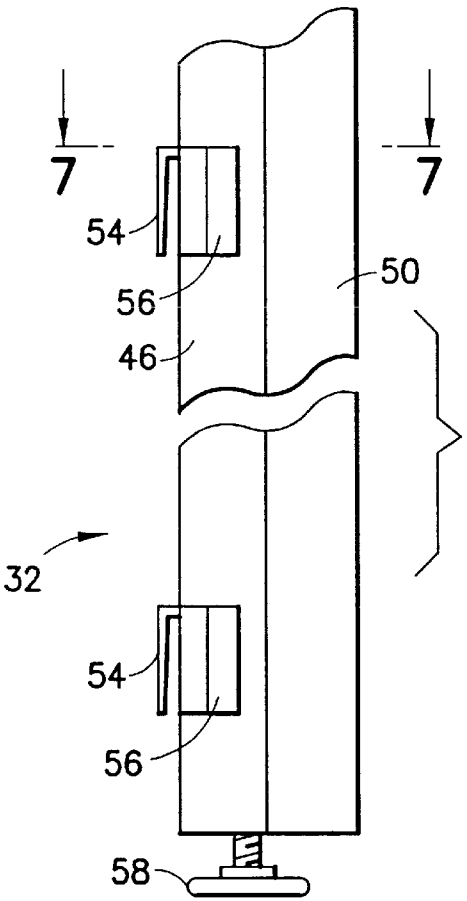
FIG. 6 is a broken side view of the wall standard of FIG. 5.
Figure 5:
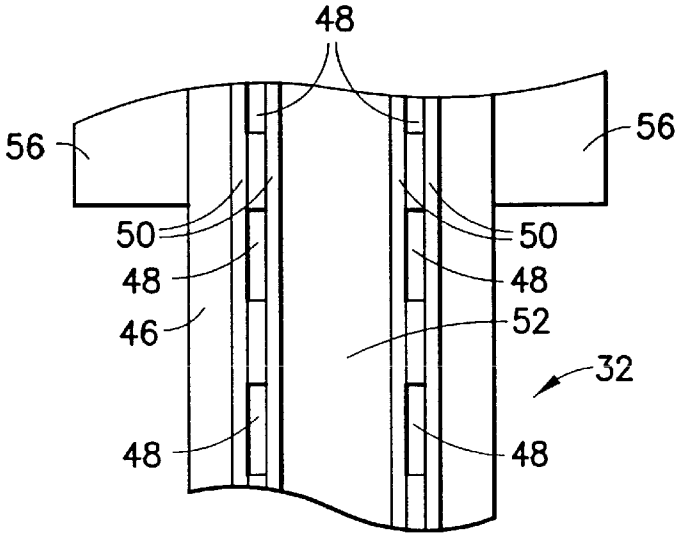
FIG. 5 is a broken front view of a wall standard according to the retail merchandising display system of the invention.
Figure 7:
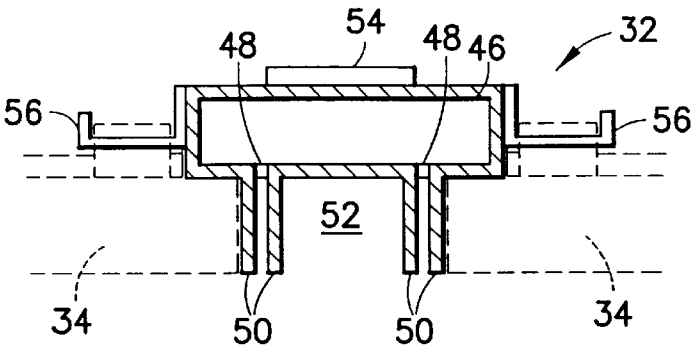
FIG. 7 is a section view across line 7—7 in FIG. 6.
Figure 8A:
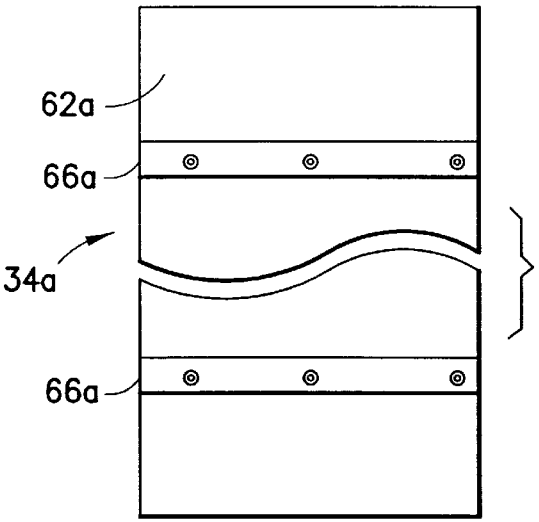
FIG. 8*a* is an alternative embodiment of a back panel.

Referring now to FIGS. 5 through 7, wall standards 32 may be attached to the wall cleat at any location along the length of the wall cleats 30. Each wall standard 32 includes a preferably metal and rectangular tubular portion 46. The front of tubular portion 46 includes pairs of vertical displaced slots 48 which are intended to receive hooks of dividers, shelf brackets, etc. Each of the two vertical arrangement of slots is surrounded by pairs of keystripping (fins) 50. The keystrippings 50 define a space 52 for a wall divider 36 (described below with reference to FIGS. 11 through 13), and also provide an abutment for back panels 34. The rear of the tubular portion 46 includes preferably two vertically displaced anchors 54. Each anchor 54 is adapted to engage in the channel 44 of a respective wall cleat 30. The sides of the wall standard 32 are optionally provided with two laterally extending brackets 56 for receiving back panel hooks 66, as discussed below. The bottom of the tubular portion 46 is preferably provided with an adjustable foot 58 which facilitates support of the wall standard 32.

Figure 9:
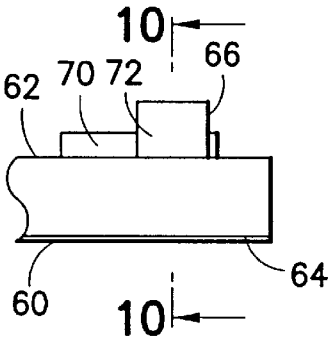
FIG. 9 is a broken top view of a corner of the back panel of FIG. 8.
Figure 10:
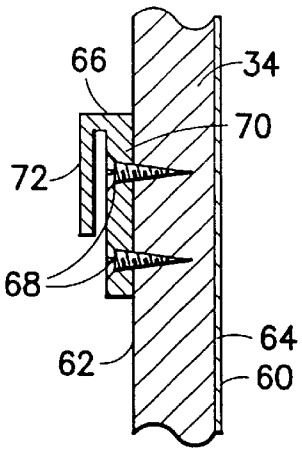
FIG. 10 is a broken section view across line 10—10 in FIG. 9.
Figure 8:
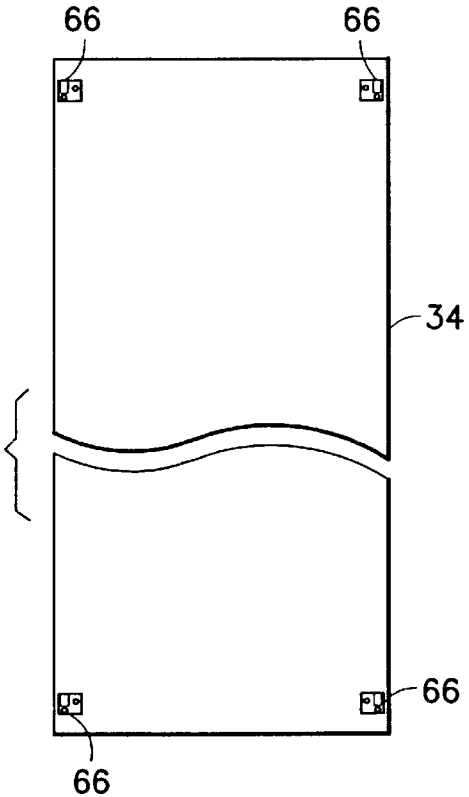
FIG. 8 is a broken rear elevation of a back panel according to the retail merchandising display system of the invention.

Referring to FIGS. 8 through 10, a back panel 34 includes a front side 60 and a rear side 62. The back panel is preferably made from wood or a plastic, such as styrene, and its front side 60 is preferably provided with a cladding 64 which corresponds to a brand identity. For example, the cladding 64 may include colored or textured materials such as metal, wood veneers, laminates, plastic, fiberglass, fabric, paint, stain, etc. The cladding may be permanently attached to the front side of the back panel or, where provided, for example, as laminates and fabrics may be removable. Alternatively, the back panel may be made from an aesthetically pleasing material such as solid wood, frosted glass, etc. As yet another alternative, the front side may be provided with a graphic 64*a* or a portion of a graphic such that when the back panels are assembled side-by-side as described below, a composite graphic 64b is created (FIG. 2). Four preferably metal rear hooks 66 are coupled, e.g., with screws 68, adjacent the corners of the panel 34 on the rear side 62. The rear hooks 66 include a mounting portion 70 and a horizontally displaced hook portion 72 adapted to catch onto the laterally extending brackets 56 of the wall standard, as shown in phantom in FIG. 7. Alternatively, referring to FIG. 8*a,* the rear side 62*a* of the back panel 34*a* may be provided with two vertically offset and parallel anchors 66*a* similar to anchors 54 on the wall standard, and the wall standard can be constructed without the laterally extending brackets 56. This arrangement permits the back panel 34*a* to be coupled directly to the wall cleats 30. The back panel 34 is preferably approximately eight feet tall, and is also preferably available in a variety of widths, e.g., three inches, two feet, four feet, and five feet. It will be appreciated that when the back panels are installed, the perimeter wall and wall cleats are completely hidden, as is the entirety of the wall standards except for the portions thereof between and including the keystripping 50.

Figure 12:
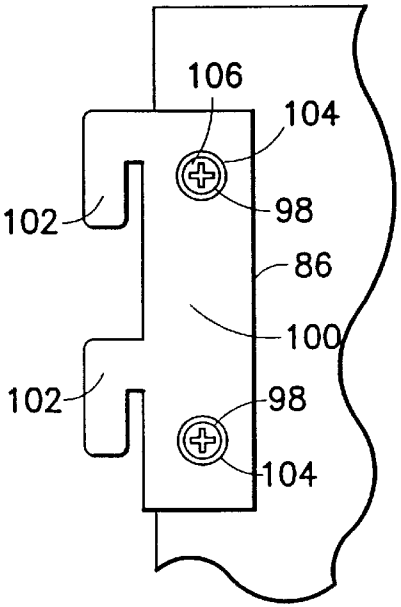
FIG. 12 is an enlarged section of the divider of FIG. 11 providing detail of a mount thereof.
Figure 11:
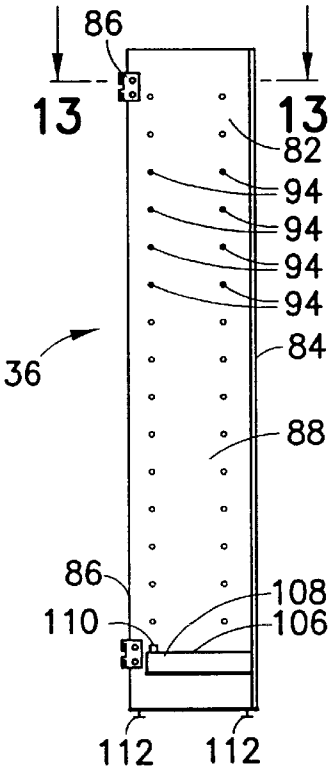
FIG. 11 is a side elevation of a divider according to the retail merchandising display system of the invention.

Referring now to FIGS. 11 through 13, the divider 36 includes a relatively narrow panel 82, a front style element 84 oriented transverse to the panel, and four preferably J-shaped metal supports 86 which attach the panel 36 to a wall standard 32 (as shown in FIGS. 5 and 7). The panel 82 is preferably made of wood or another relatively strong material, and has two relatively large planar sides 88, 90. The sides may optionally be provided in cladding 92. The panel 82 also includes multiple rows of holes 94 adapted to receive shelving supports, etc. The style element 84 includes a recess 93 in which the front edge 95 of the panel is received and secured. Alternatively, the style element 84 may be coupled to the panel with hardware. The style element is preferably either made of a material or covered in a cladding which, in conjunction with other cladding in the system, operates to provide brand identity. The supports 86 are located two on each side of the panel, adjacent top and bottom portions of the panel. Each support 86 includes a relatively short portion 96 provided with two mounting holes 98, and a horizontally-displaced bracket 100 terminating in two hooks 102. The bracket 100 also includes two clearance holes 104 aligned with and relatively larger than the mounting holes 98. As such, the support 86 is coupled to the panel 82 by inserting screws 106 completely through the clearance holes 104 and into the mounting holes 98, which are smaller than the heads of the screws. To couple a divider 36 to a wall standard 32 (FIG. 7), the brackets 100 on the divider are inserted between the keystripping 50 of the wall standard and the hooks 102 are inserted into slots 48 and pushed down to lock the divider to the standard 32. The lower portion of the divider is provided with two base mounts 106, one on each side of the divider. Each base mount 106 generally includes a rectangular rib 108, two pins (not shown) which extend into a lower row of holes in the panel, and one pin 110 which vertically extends from the rear of the rib, the purpose of which is described below. In addition, the bottom of the panel is preferably provided with two adjustable feet 112.

Referring now to FIG. 14, a base 38 includes a rectangular top element 114, a front element 116, a two feet 118 (one shown). The exposed sides of the top and front elements are provided with cladding. The lower side of the top element includes two rear holes 120 adjacent the edges of the base. The pins 110 of two dividers 36 fit snugly into the holes 120 to secure the base 38 to the dividers. The feet 118 are attached to the front element with L-brackets 122 to recess the feet from the front element.

Figure 15:
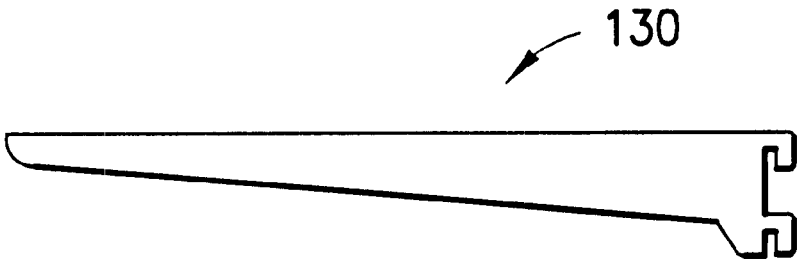
FIG. 15 is a side elevation of a shelf bracket according to the retail merchandising display system of the invention.
Figure 16:
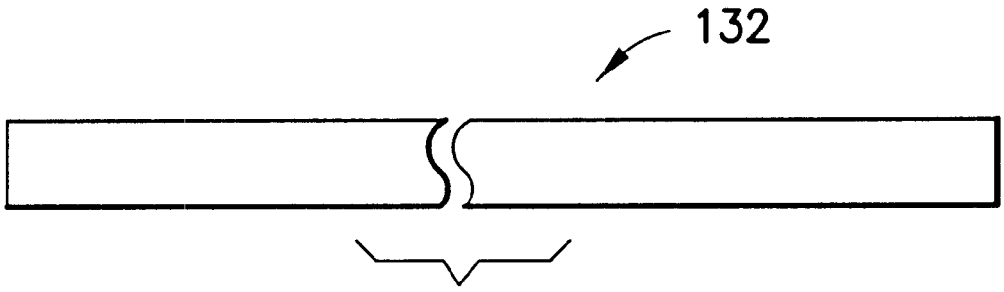
FIG. 16 is a front view of a shelf according to the retail merchandising display system of the invention.

Referring to FIGS. 15 and 16, other basic elements used in the system include shelf brackets 130 which engage in the slots 44 of the wall standard, shelves 132 which rest on the shelf brackets, and garment bars 22 (see FIG. 2) which also engage in the slots in the wall standard.

The above elements can be assembled in a perimeter wall fixture 14 as follows. First, the wall cleats 30 are affixed along a wall of a retail establishment as described above. Second, wall standards 32 are hooked onto the wall cleats 30 at the ends of the wall cleats and at intervals at which it is desired to have dividers 36. Third, back panels 34 are provided between the standards 32 and are coupled to either the standards or the wall cleats. As shown in FIGS. 5 and 7, the sides of the back panels 34 fit snugly against the keystripping 50 and square-off the standards, as well as provide a recessed appearance for the keystripping of the standards. As such, the wall fixture now includes the appearance of a plurality of back panels 34 provided side-by-side and interposed by portions of the standards. Fourth, the dividers 36 are hooked into the slots 44 of the standards 32. it should be appreciated that even though each divider is attached to a standard, all slots in the standard but the slots which are used to attach a divider to the standard are accessible and available for attaching other elements, such as shelf brackets 130 and garment bars 22. Fifth, bases 38 are coupled between dividers 36 by providing the rear holes 120 on the top element 114 of the bases over the pins 110 on the base mounts 106 of the dividers 36. The shelf brackets 130 and garment bars are then attached to the standard 32 and shelves 132 are then rested on the shelf brackets. Alternatively, shelves can be attached directly to the dividers with pin supports provided in the holes in the standard. It will be appreciated that based on the selected spacing of the standards and sizes of the bases, the material and/or cladding used, and the style elements, the wall fixture can assume various configurations and represent numerous brand identities.

Figure 17:
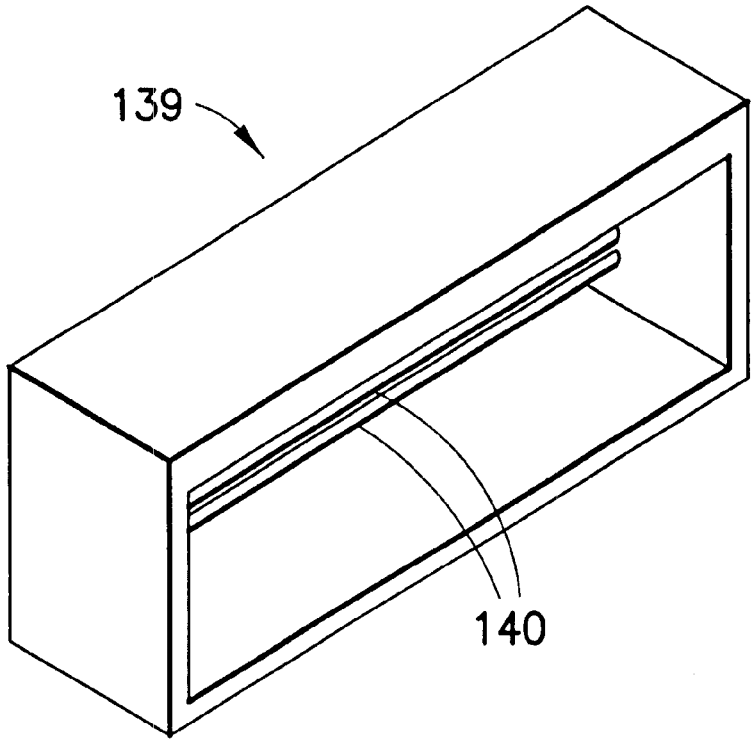
FIG. 17 is perspective view of a light box according to the retail merchandising display system of the invention.
Figure 18:
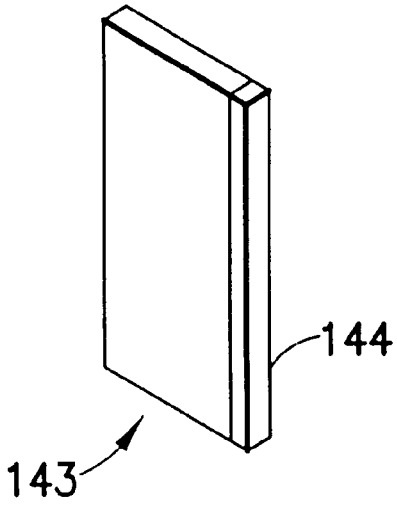
FIG. 18 is a perspective view of a light box spacer according to the retail merchandising display system of the invention.

In addition to the basic elements to the perimeter wall fixture, several optional elements may also be used to add height to the wall fixture. For example, referring to FIG. 17, light box units 139, which are preferably provided in the same widths as the back panels 34, can be mounted over the assembled elements. Each light box unit 139 preferably includes one or more light bulbs 140, as well as sockets and electric cords therefor (not shown). A preferably milk-colored plexiglass 141 is provided over the fronts thereof. A graphic display 142 may be provided over the plexiglass 141 (FIG. 2). The light box units 139 are preferably coupled to a third row of wall cleats (not shown) located above the two rows previously discussed. Referring to FIG. 18, spacers 143 having style elements 144 on a front thereof can be interposed between the light boxes 139 to maintain a uniform design with the style elements 86 of the dividers 36 therebelow.

Figure 19:
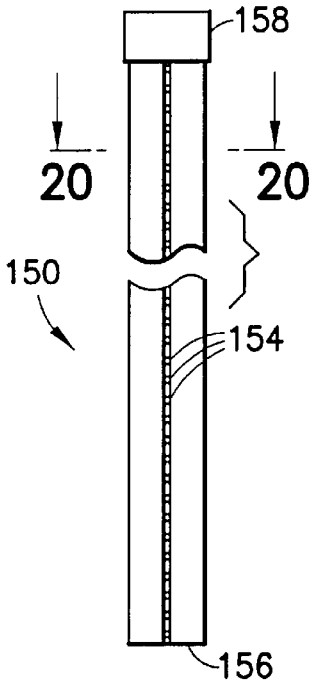
FIG. 19 is a broken side elevation of a quad upright post according to the retail merchandising display system of the invention.
Figure 20:
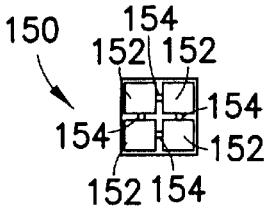
FIG. 20 is a section view across line 20—20 in FIG. 19.

The fixtures and tables of the invention are assembled from 16 several interchangeable components which can also be customized and clad for brand identity. Turning now to FIGS. 19 and 20, a quad upright post 150 is shown. The quad upright post 150 defines four vertical channels 152 and a set of vertically displaced slots 154 on each of its four sides. The slots 154 are sized and perform in the same manner as the slots 44 on the standard 32. The post includes a solid bottom 156 having one small hole (not shown) aligned with each of the channels, and a removable top cap 158.

Figure 21:
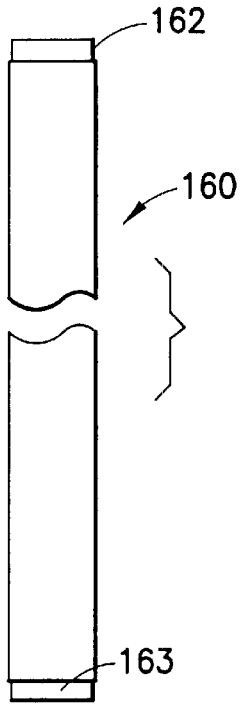
FIG. 21 is a broken side elevation of a quad upright post sleeve according to the retail merchandising display system of the invention.
Figure 23:
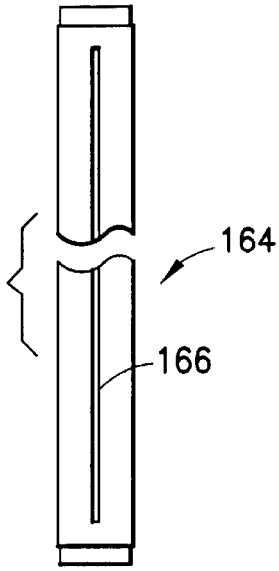
FIG. 23 is a broken side elevation of a quad upright post slotted sleeve according to the retail merchandising display system of the invention.
Figure 22:
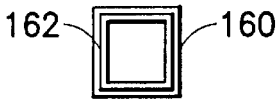
FIG. 22 is a top view of the quad upright post sleeve of FIG. 21.

Referring to FIGS. 21 and 22, a quad post sleeve 160 is provided for placement over the quad upright post 150. The post sleeve 160 is generally a square tubular element with slightly smaller ends 162, 163. End 162 is sized to fit between the quad post 150 and its cap 158, and end 163 is sized to fit within the tubular post 178 of the quad base 170, described below with reference to FIGS. 24 and 25. The sleeve 160 operates as cladding for the upright post 150, and can be provided in or covered in numerous materials, colors, textures, etc. A slotted quad post sleeve 164 is shown in FIG. 23. The slotted quad post sleeve 164 is similar to sleeve 160, but includes slots 166 on each of its four sides which permit an element to be inserted therethrough and into the slots 154 in the quad upright post 150 within the sleeve 164. The sleeve 160 functions as 'cladding' for the base and may be made from decorative materials such as wood, plastic, metal, fiberglass, etc. to correspond to a brand identity.

Figure 24:
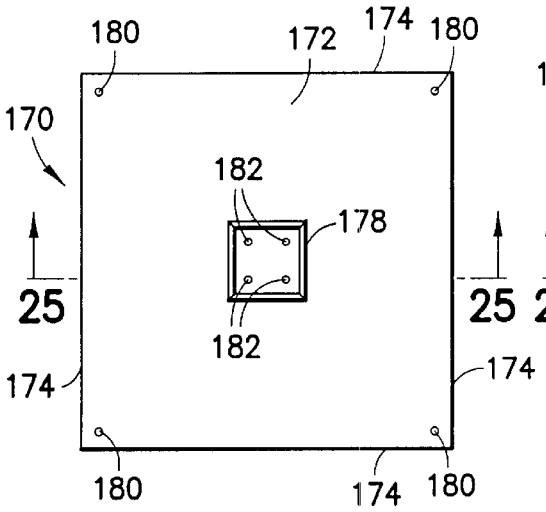
FIG. 24 is a top view of a quad base according to the retail merchandising display system of the invention.
Figure 26:
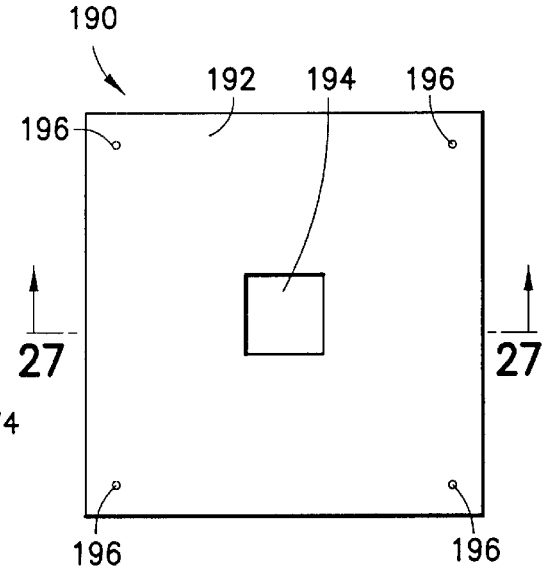
FIG. 26 is a top view of a quad base sleeve according to the retail merchandising display system of the invention.
Figure 25:
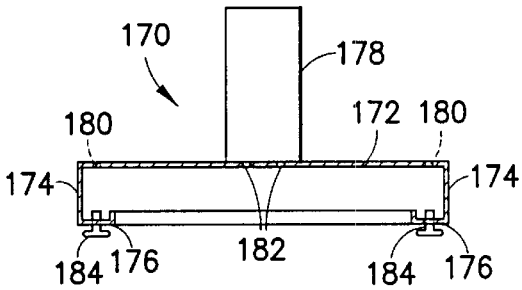
FIG. 25 is a section view across line 25—25 in FIG. 24.
Figure 27:
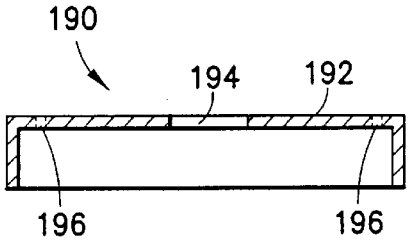
FIG. 27 is a section view across line 27—27 in FIG. 26.

Referring to FIGS. 24 and 25, a square quad base 170 is provided for the quad upright post 150. The base 170 includes a top 172, four sides 174, and a bottom lip 176. A central square tubular post 178 sized to receive the quad upright post 150 is welded in the center of the top 172. The top 172 includes a hole adjacent 180 each of its corners, as well as four holes 182 within the tubular post. The bottom lip 176 is provided with an adjustable foot 184 adjacent at each of its corners. Referring to FIGS. 26 and 27, a square base sleeve (or cover) 190 is provided for covering the square base 170. The base sleeve 190 includes a top 192 having a hole 194 for receiving the square tubular post 178 of the base 170, as well as four bores 196 at which the base sleeve 190 is coupled to the base 170 with screws or bolts (not shown) that extend through holes 180 in the base.

Referring now to FIGS. 28 and 29, a preferably non-square rectangular twin upright post 192, substantially similar to the quad upright post 150, but with only two channels 194, is shown. Two sets of slots 196 are provided, each in the longer sides of the post. FIGS. 30 and 31 show a twin upright post sleeve 198 sized to fit over the twin upright post 192. FIGS. 32 and 33 show a twin base 200, substantially similar to quad base 170, adapted to support the twin upright post 192. The twin base 200 includes a rectangular tubular post 202 sized and shaped to receive the lower end of the twin upright post, and two holes 204 to permit bolting the lower end of the twin upright post to the twin base 200. FIGS. 34 and 35 show a twin base sleeve 206, substantially similar to quad base sleeve 190, but having a central hole 208 which is rectangular in shape and sized to fit over the rectangular tubular post 202.

Figure 36:
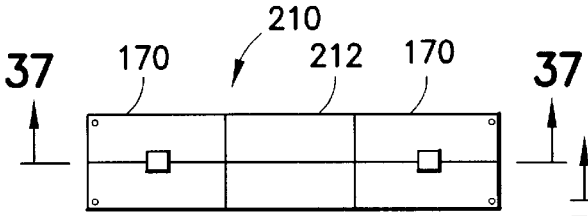
FIG. 36 is a top view of a three part double-post base according to the retail merchandising display system of the invention.
Figure 38:
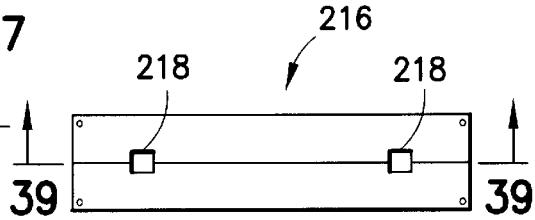
FIG. 38 is a top view of a triple length double-post base sleeve according to the retail merchandising display system of the invention.
Figure 37:
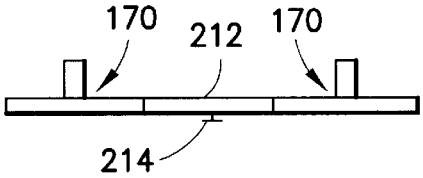
FIG. 37 is a section view across line 35—35 in FIG. 34.
Figure 39:
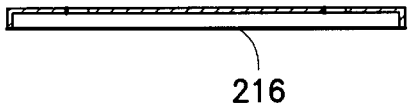
FIG. 39 is a section view across line 39—39 in FIG. 38.

Referring now to FIGS. 36 and 37, a three part double-post base 210 includes two quad bases 170 and a central spacer 212 therebetween. The central spacer 212 is coupled to the adjoining sides of the quad bases to result in a stable composite three part double-post base. The central spacer preferably includes adjustable feet 214. Referring to FIGS. 38 and 39, a double post base sleeve 216 is shown. The double post base sleeve 216 is an elongate sleeve similar to quad base sleeve 190, but includes two openings 218 which receive the tubular posts 178 of the quad bases 170. The double-post base sleeve 216 is provided over and secured to the composite three part double-post base 210.

Figure 42:
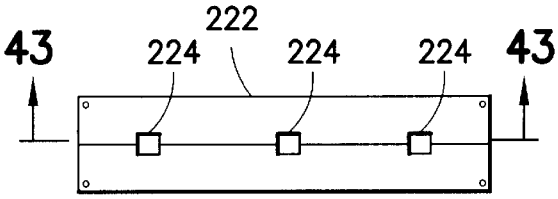
FIG. 42 is a top view of a triple length triple-post base sleeve according to the retail merchandising display system of the invention.
Figure 40:
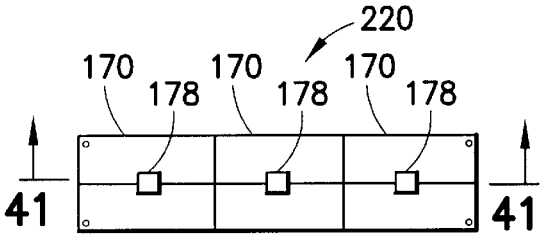
FIG. 40 is a top view of a three part triple-post base according to the retail merchandising display system of the invention.
Figure 43:
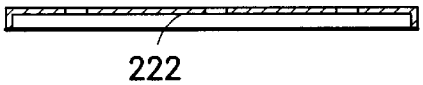
FIG. 43 is a section view across line 43—43 in FIG. 42.
Figure 41:
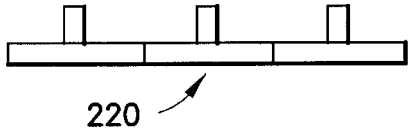
FIG. 41 is a section view across line 41—41 in FIG. 40.

Referring now to FIGS. 40 and 41, a three part triple-post base 220 includes three quad bases 170 linearly coupled to each other to result in a stable composite three part triple-post base. Referring to FIGS. 42 and 43, a triple-post base sleeve 222, similar to double-post base sleeve 216, but including three openings 224 is shown and is adapted to receive the tubular posts 178 of the quad bases 170. The triple post base sleeve 216 is provided over and secured to the composite three part triple-post base 220.

Figure 44:
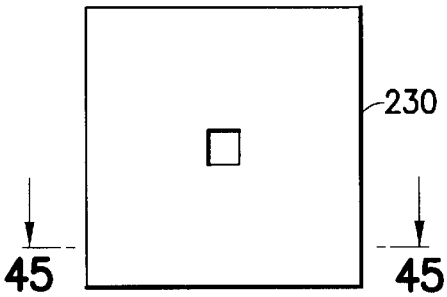
FIG. 44 is a top view of a table base sleeve according to the retail merchandising display system of the invention.
Figure 45:
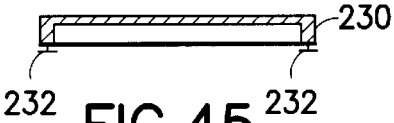
FIG. 45 is a section view across line 45—45 in FIG. 44.

Referring now to FIGS. 44 and 45, a table base sleeve 230 is shown. The table base sleeve 230 is substantially similar in design to quad base sleeve 190, but is substantially larger in size (e.g., approximately four times the area), thereby providing the appearance of a relatively larger base. The table base sleeve 230 is adapted to be coupled over and to a base 170 or 200, in preferably the same manner as a quad base sleeve 190 is coupled to a quad base 170, and is provided with adjustable feet 232 at its corners to stabilize the assembly. The table base sleeve 230 is provided with a cladding, and may be in a shape other than square, e.g., round, oval, or rectangular, provided that table base sleeve fits over a base 170 or 200.

Figure 46:
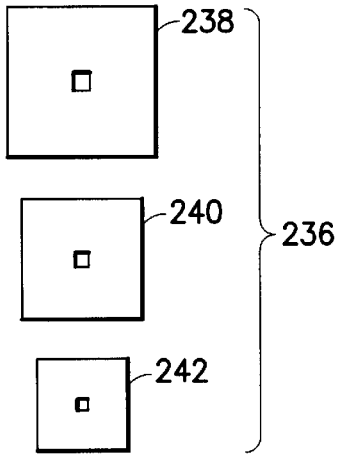
FIG. 46 is top views of individual table shelves according to the retail merchandising display system of the invention.

Referring now to FIG. 46, a table shelf kit 236 is shown which includes three substantially square table shelves 238, 240, 242 of three different sizes. The table shelves are preferably formed in a manner similar to the base sleeves such that each includes a top and sides, but no bottom lip. Additional table shelves each a different size from the table shelves or the same size as one or more of the table shelves may also be provided. The table shelves are provided in a cladding. Further, the table shelves may be in a shape other than square, e.g., round, oval, or rectangular.

Figure 47:
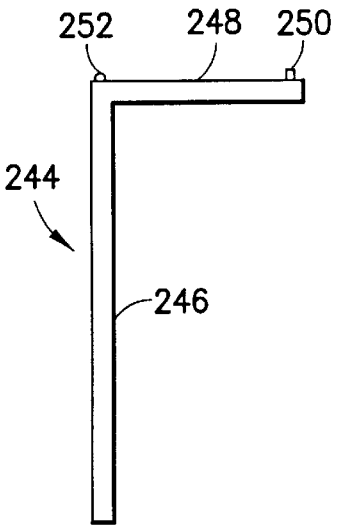
FIG. 47 is a side elevation of a T-stand arm according to the retail merchandising display system of the invention.
Figure 49:
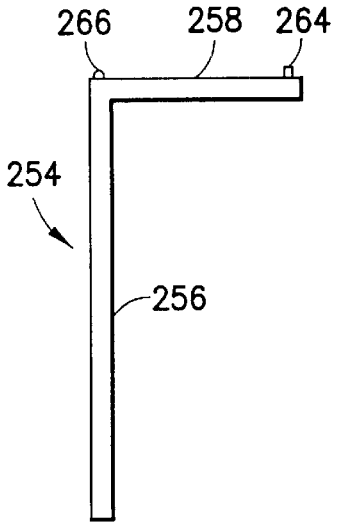
FIG. 49 is a side elevation of a four-way arm according to the retail merchandising display system of the invention.
Figure 52:
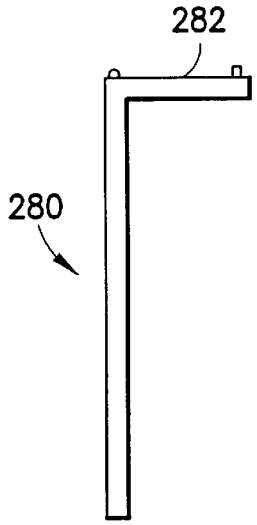
FIG. 52 is a side elevation of a face-out arm according to the retail merchandising display system of the invention.
Figure 48:
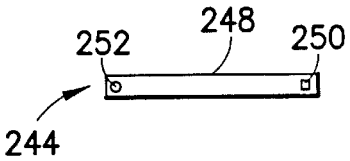
FIG. 48 is a top view of the T-stand arm of FIG. 47.
Figure 50:
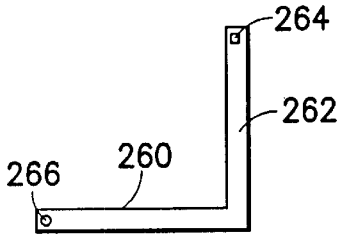
FIG. 50 is a top view of the four-way arm of FIG. 49.
Figure 51:
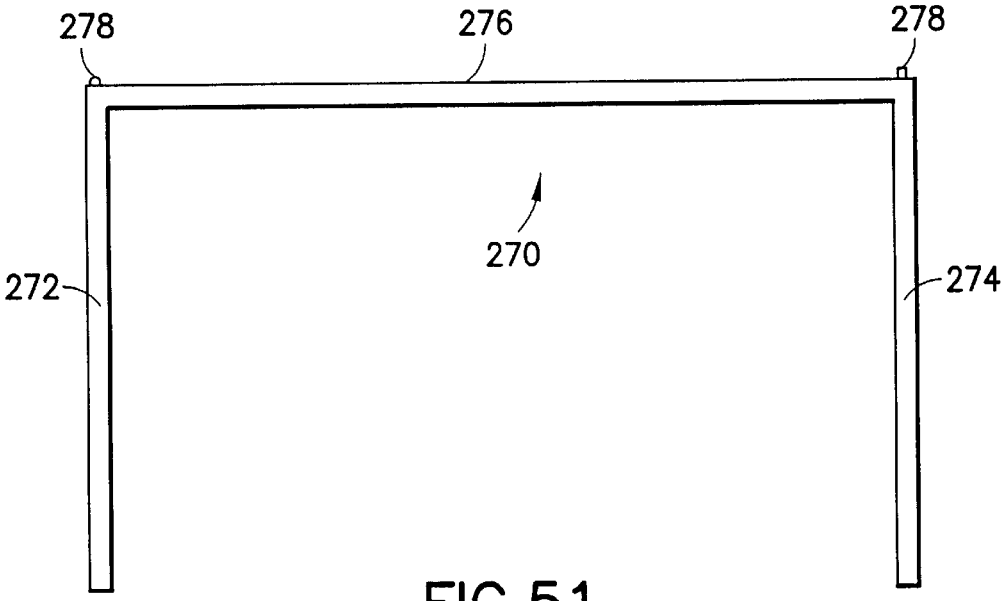
FIG. 51 is a side elevation of a rail arm according to the retail merchandising display system of the invention.

Referring to FIGS. 47 and 48, a T-stand arm 244 includes a vertical leg 246, a horizontal extension 248, a stop 250 at the end of the extension, and a button 252 atop the vertical leg of the support which facilitate movement of a locking flange (not shown) on the bottom of the support. The vertical leg 246 is sized to be stably received in the vertical channels 152, 194 (FIGS. 20 and 26) of a quad or twin upright post 150, 192. In a manner well-known in the art, providing manual force against the button 252 moves the flange and permits the vertical leg 246 of the T-stand arm to be moved vertically within the channel, and release of the button releases the flange and locks the T-stand arm at a vertical location within the channel of the post. T-stand arms 244 are provided having extension 248 of various lengths. FIGS. 49 and 50 show a four-way arm 254 which includes a vertical leg 256, and an L-shaped horizontal extension 258 including two orthogonal portions 260, 262, a stop 264 at the end of the extension, and a button 266 atop the vertical leg. FIG. 51 shows a rail arm 270 which includes two vertical supports 272, 274 sized to fit within the vertical channels of either of the quad and twin upright posts, and a horizontal extension 276 therebetween. Buttons 278 are provided at the top of the supports 272, 274 to permit the rail arm to be moved vertically within channels of twin or quad upright posts and locked at a vertical position therein. FIG. 52 shows a face-out arm 280 which is substantially similar to the T-stand arm but includes a relatively shorter horizontal extension 282.

Figure 53:
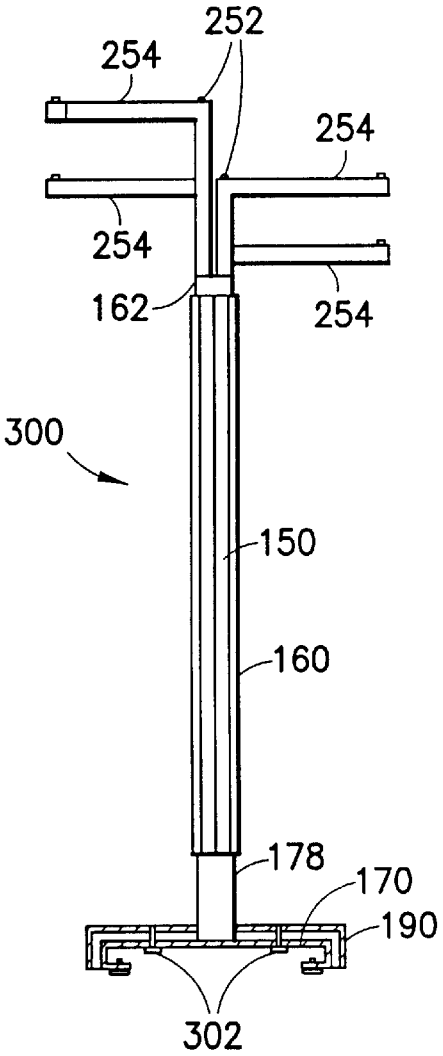
FIG. 53 is a partial section view of a first exemplar fixture made from various elements of the retail merchandising display system of the invention.

Referring now to FIG. 53, a first exemplar fixture 300 assembled from certain of the above described components is now described. The fixture 300 is a four way stand and is assembled as follows. A quad base sleeve 190 is assembled over a quad base 170 with screw or bolts 302. A quad upright post 150 is bolted in the tubular post 178 of the quad base 170, the cap 158 (FIG. 20) is removed, and a quad upright sleeve 160 is extended over the upright post 150. The bottom end 163. (FIG. 21) of the quad upright sleeve 160 is inserted into the top of the tubular post 178 of the base. Four four-way arms 254 are then provided in the channels 152 of the upright post 150 with each being offset ninety degrees relative to adjacent arms 254. The arms 254 may optionally be positioned at different heights by pressing the buttons 252 to enable the arms to be moved vertically within the channels 152, and releasing the buttons to fix the arms at the desired vertical position.

Figure 54:
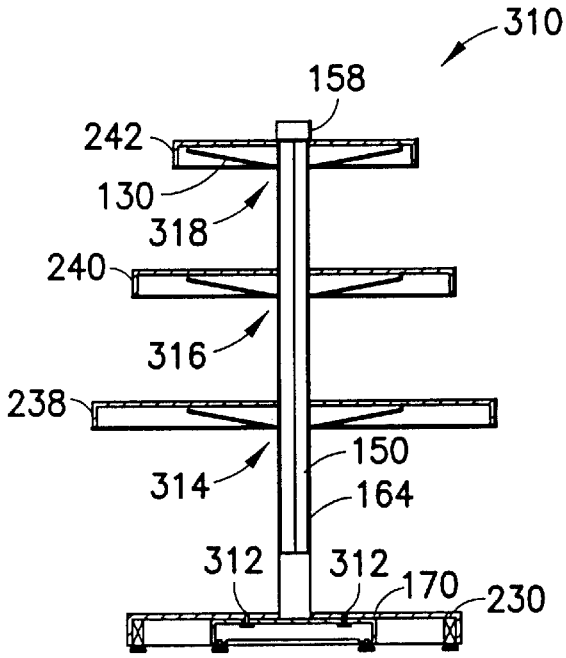
FIG. 54 is a partial section view of a second exemplar fixture made from various elements of the retail merchandising display system of the invention.

Referring now to FIG. 54, a second exemplar fixture, a multi-tier shelf table 310 is assembled as follows from some of the same components used in the assembly of the four-way stand and some additional components. A table sleeve 230 is assembled over a quad base 170 with screw or bolts 312. A quad upright post 150 is then bolted in the tubular post 178 of the quad base 170. The cap 158 is removed from the upright post 150, and a slotted quad upright sleeve 160 is then extended over the upright post 150. The bottom end 163 of the sleeve is inserted into the top of the tubular post 178 of the base. A first set 314 of four shelf brackets 130 are then inserted through the slots 166 in the upright sleeve 160 and coupled in relatively lower slots 154 of the upright post 150. A relatively large table shelf 238 is then seated on the set 314 of shelf brackets. A second set 316 of four shelf brackets 130 are then inserted through the slots 166 in the upright sleeve 160 and coupled in relatively central slots 154 of the upright post 150, and a medium-sized table shelf 240 is placed thereon. A third set 318 of four shelf brackets 130 are then inserted through the slots 166 in the upright sleeve 160 and coupled in relatively higher slots 154 of the upright post 150, and a small-sized table shelf 242 is placed thereon. The cap 158 is then replaced over both the top of the upright post 150 and the top end 132 of the slotted quad upright sleeve 164. It will be appreciated that the multi-tier shelf table 310 is scalable and can be provided with fewer or additional sets of shelf brackets and table shelves to increase or decrease the capacity of the table 310.

Figure 16A:
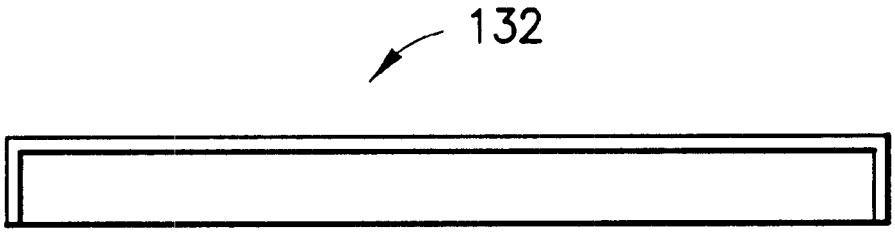
FIG. 16*a* is a rear view of the shelf of FIG. 15.
Figure 55:
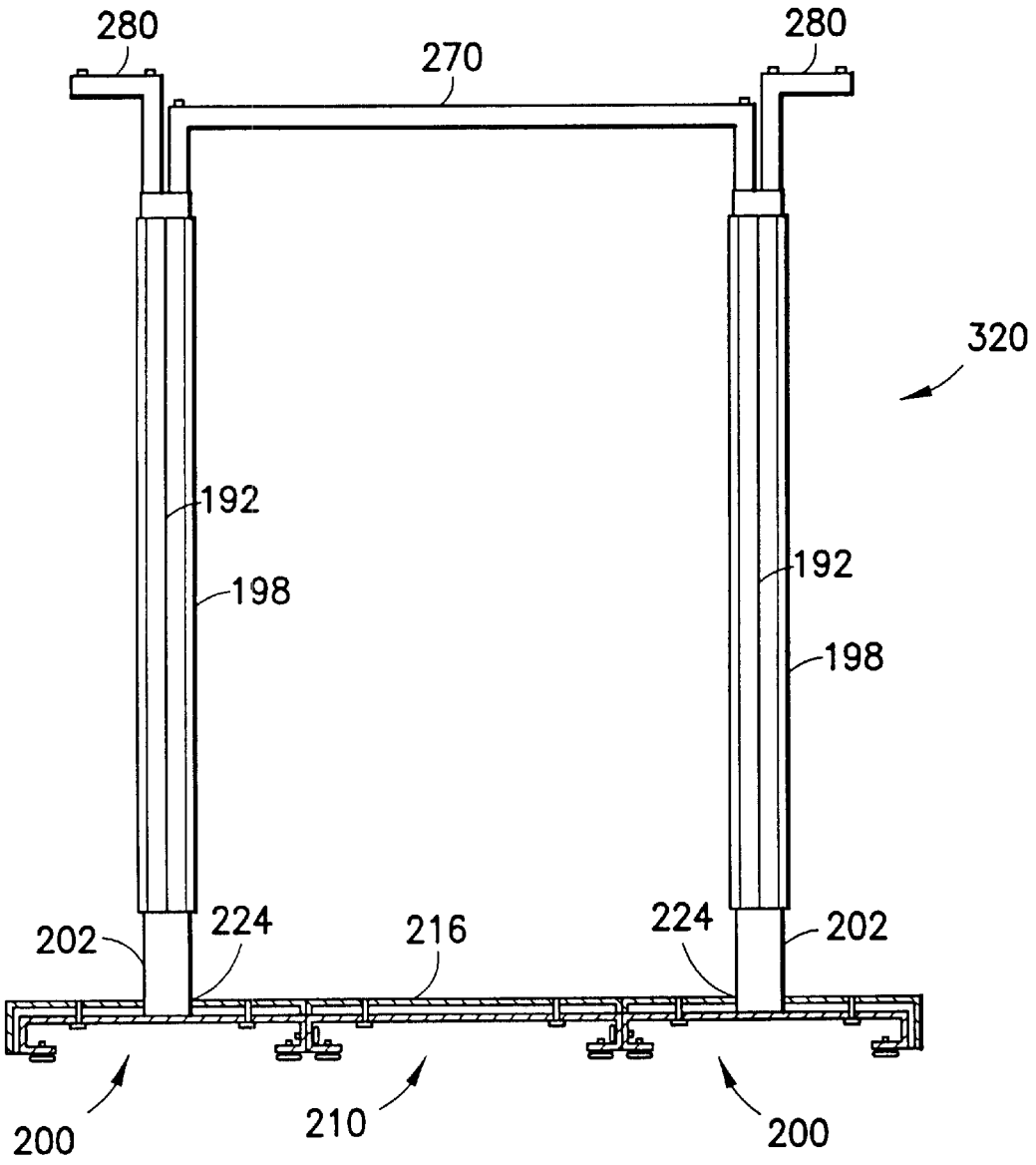
FIG. 55 is a partial section view of a rail arm fixture made from various elements of the retail merchandising display system of the invention.

Referring now to FIG. 55, a third exemplar fixture, a single rail fixture 320 is assembled as follows. A three part double post base 210 having twin bases 200 is provided with and coupled to a double-post base sleeve 216 having openings 224 sized for the tubular posts 202 of the twin bases 200. Twin posts 192 are then coupled within each of the tubular posts 202 of the bases 200, and the twin posts are then covered in twin post sleeves 198. A rail arm 270 is coupled in channels of each of the twin posts, and the other channels are provided with face-out arms 280. It will be appreciated that if slotted twin post sleeves are used, shelf brackets 130 (FIG. 15) may be installed in the slots of the post (extending orthogonal relative to the rail arm 270), and shelves 132 (FIGS. 16 and 16*a*) may be provided thereon to create a 'collection' fixture.

In view of the foregoing examples, it will be appreciated that numerous other fixtures can be assembled from the above described elements, including, but not limited to, T-stands, round and rectangular tier tables, and 'collection' fixtures and 'lifestyle' fixtures (both combining arms, rails, and shelves), and of a type well-known in the art of retail merchandise displays. Moreover, as the elements of the various fixtures are interchangeable, unused fixtures can be disassembled and converted into other fixtures for which there may be a greater need.

It will be appreciated that the decorative post sleeves and base sleeves, as well any decorative shelves or tables utilized therewith, provide a customized appearance to the fixture on which they are used. Changing between different sleeves, shelves, and tables, as applicable, on a fixture permit that fixture to be rapidly customized and provided with different aesthetic appearances which preferably correspond to different brand identities.

There have been described and illustrated herein several embodiments of a reconfigurable retail merchandising system. While particular embodiments of the invention have been described, it is not intended that the invention be limited thereto, as it is intended that the invention be as broad in scope as the art will allow and that the specification be read likewise. Thus, while fixtures have been described as being assembled from particular elements in a stated order, it will be appreciated that the elements may be assembled in a different order to create the fixtures. In addition, while particular materials for both structural and cladding elements have been disclosed, it will be understood that other suitable materials can be used as well. Also, while particular preferred dimensions have been disclosed, it will be recognized that other suitable dimensions may be used as well. Furthermore, while the perimeter wall fixtures and free-standing fixtures have been shown with respect to the retail display of apparel, it will be appreciated that the system of the invention can be used to display in a retail setting any merchandise, e.g., cosmetics, accessories, electronics, etc. It will therefore be appreciated by those skilled in the art that yet other modifications could be made to the provided invention without deviating from its spirit and scope as claimed.

What is claimed is:

1. A modular fixture system for retail merchandise display in a store having a perimeter wall, comprising:

a) an elongate wall cleat adapted to be secured to the perimeter wall and defining a first coupling means;

b) a wall standard including a first rear hook structure which removably engages said first coupling means, and a front arrangement of vertically displaced slots;

c) a back panel including second coupling means for removably coupling to one of said first coupling means of said wall cleat and said wall standard; and d) a divider including a second rear hook structure which removably locks into said slots in said wall standard.

2. A modular fixture system according to claim 1, wherein:

said first coupling means is at least one of channel and a lip.

3. A modular fixture system according to claim 1, wherein:

said wall cleat is substantially J-shaped.

4. A modular fixture system according to claim 1, wherein:

said first coupling means is elongate, and said first rear hook structure of said standard is adapted to be coupled to said first coupling means of said wall cleat at substantially any location along a length of said first coupling means.

5. A modular fixture system according to claim 1, wherein:

said standard is slidable along said first coupling means of said wall cleat.

6. A modular fixture system according to claim 1, wherein:

said wall standard is tubular.

7. A modular fixture system according to claim 1, wherein:

said wall standard includes two sets of vertically arranged slots, each set being horizontally displaced relative to the other.

8. A modular fixture system according to claim 1, wherein:

said wall standard includes laterally extending brackets, and said back panel includes hooks for coupling to said laterally extending brackets.

9. A modular fixture system according to claim 1, wherein:

said first and second coupling means comprise hooks.

10. A modular fixture system according to claim 1, wherein:

said back panel is provided with a graphic.

11. A modular fixture system according to claim 1, wherein:

said hook means of said divider includes a plurality of hooks which lock into a plurality of slots in said wall standard.

12. A modular fixture system according to claim 1, further comprising:

a front style element coupled to said divider.

13. A modular fixture system according to claim 1, further comprising:

e) a base couplable to said divider.

14. A modular fixture system according to claim 1, further comprising:

e) a light box coupled to the wall above said back panel.

15. A modular freestanding rack fixture for retail merchandise display, comprising:

a) a base;

b) a decorative cover removably coupled to said base such that said cover substantially covers said base;

c) a post vertically coupled to said base and including a plurality of vertical channels; and d) an arm including a vertical element which extends within one of said vertical channels.

16. A modular freestanding rack fixture according to claim 15, wherein:

said post is removably coupled to said base.

17. A modular freestanding rack fixture according to claim 15, further comprising:

e) a tubular sleeve extending over said post.

18. A modular freestanding rack fixture according to claim 15, wherein:

said post includes one of two channels or four channels.

19. A modular freestanding rack fixture according to claim 15, wherein:

said arm has an L-shaped horizontal extension.

20. A modular freestanding rack fixture for retail merchandise display, comprising:

a) a base;

b) a post vertically coupled to said base;

c) a decorative tubular sleeve removably provided over said post; and d) at least one horizontally extending arm coupled to said post.

21. A modular freestanding rack fixture according to claim 20, wherein:

said arm is L-shaped.

22. A modular freestanding rack fixture according to claim 20, wherein:

said post includes at least two channels, and each of said at least one arm includes a vertical position which extends into one of said channels.

23. A modular freestanding table fixture for retail merchandise display, comprising:

a) a base;

b) a post vertically coupled to said base and having four sides, and including in each of said sides a set of vertically displaced slots;

c) a bracket received in a slot of each of said sets of vertically displaced slots, said sets of vertically displaced slots being adapted to receive said brackets in a plurality of vertical positions; and d) a table element resting on said brackets.

24. A modular freestanding table fixture for retail merchandise display, comprising:

a) a base;

b) a post vertically coupled to said base and having a plurality of sides, and including in each of said sides a set of vertically displaced slots;

c) a bracket received in a slot of each of said sets of vertically displaced slots, said sets of vertically displaced slots being adapted to receive said brackets in a plurality of vertical positions;

d) a table element resting on said brackets; and e) a base cover coupled over said base for substantially covering said base.

25. A modular freestanding table fixture according to claim 24, wherein:

said base cover is substantially larger than said base.

26. A modular freestanding table fixture according to claim 24, wherein:

a plurality of brackets are provided in each set of slots, defining a plurality of tiers of brackets, and a table element is provided on each of said tiers of brackets.

27. A modular assembly for a retail merchandise fixture, comprising:

a) a first base;

b) a decorative cover coupled to said base to substantially cover said base; and c) a first post vertically coupled to said first base and including a plurality of sets of vertically displaced slots.

28. A modular assembly according to claim 27, wherein:

said post includes four sides, and a set of slits is provided in each of at least two of said four sides.

29. A modular assembly according to claim 27, wherein:

said post includes at least two vertical channels.

30. A modular assembly according to claim 27, further comprising:

f) a second base; and g) a second post coupled to said second base, wherein said decorative cover is coupled to and covers both of said first and second bases.

31. A modular assembly according to claim 27, further comprising:

d) a decorative sleeve removably extended over said first post.

32. A modular fixture for attachment to a wall, comprising:

a) a coupling means attached to the wall; and b) a plurality of components which are coupled to said coupling means to provide a perimeter wall fixture but which are reconfigurable with respect to said coupling means and each other to provide a plurality of appearances to said perimeter wall fixture.

33. A modular retail merchandising display system for use in a room having a wall, comprising:

a) a perimeter wall fixture coupled to the wall;

b) a freestanding table fixture; and c) a freestanding rack fixture, wherein each of said wall fixture, said table fixture, and said rack fixture include a component provided with vertically displaced slots.

34. A modular retail merchandising display system according to claim 33, wherein:

said component is tubular.

35. A modular retail merchandising display system according to claim 33, wherein:

said component includes a plurality of sets of vertically displaced slots.

36. A modular retail merchandising display system according to claim 33, wherein:

said rack fixture and said table fixture each have removable decorative covers.

37. A modular retail merchandising display system according to claim 36, wherein:

said decorative covers match said perimeter wall fixture to provide a brand identity.

38. A modular retail merchandising display system, comprising:

a) a perimeter wall fixture;

b) a freestanding table fixture; and c) a freestanding rack fixture, wherein said table fixture and said rack fixture are each provided with removable decorative covers.

39. A modular retail merchandising display system according to claim 38, wherein:

said decorative covers match said perimeter wall fixture to provide a brand identity.

40. A modular fixture system for retail merchandise display in a store having an interior perimeter wall, comprising:

a) an elongate wall cleat adapted to be secured to the perimeter wall and defining a first coupling means;

b) a wall standard including a first rear hook structure which removably engages said first coupling means, a front pair of vertical keystripping, and a front arrangement of vertically displaced slots between said pair of keystripping; and c) a back panel including second coupling means for removably coupling to one of said first coupling means of said wall cleat and said wall standard, wherein when said back panel is coupled to said one of said first coupling means of said wall cleat and said wall standard, said back panel operates to substantially hide said perimeter wall therebehind, said wall cleat, and portions of said wall standard laterally of said pair of keystripping.

41. A modular fixture system according to claim 40, further comprising:

d) a divider including a second rear hook structure which removably locks into said slots in said wall standard.

42. A modular fixture system according to claim 41, further comprising:

e) a style element on a front portion of said divider, wherein said back panel, said divider, and said style element provide an integrated aesthetic appearance.

43. A modular fixture system according to claim 41, further comprising:

e) a light box; and f) a base element, wherein said light box and said base element provide an integrated aesthetic appearance with said back panel and said divider.

* * * * *